United States Patent [19]

Rhodes

[11] 4,179,963

[45] Dec. 25, 1979

[54] SCRAG SAW MILL DOGGING SYSTEM

[76] Inventor: Lloyd E. Rhodes, 242 Lake St., Bellingham, Mass. 02019

[21] Appl. No.: 913,793

[22] Filed: Jun. 8, 1978

[51] Int. Cl.[2] ..... B27B 7/00; B27B 29/04

[52] U.S. Cl. ..... 83/409; 83/425.2; 83/435.1; 83/437; 269/58

[58] Field of Search ..... 83/425.2, 425.3, 435.1, 83/409, 437, 412; 144/312; 269/58, 25, 26, 30, 54.2

[56] References Cited

U.S. PATENT DOCUMENTS

| | | | |
|---|---|---|---|
| 2,651,335 | 9/1953 | Stagg | 83/425.3 |
| 3,603,362 | 9/1971 | Neild | 83/409 X |
| 3,875,841 | 4/1975 | Noble et al. | 83/435.1 X |
| 4,117,755 | 10/1978 | Hasenwinkle et al. | 83/435.1 |

*Primary Examiner*—Donald R. Schran
*Attorney, Agent, or Firm*—Russell & Nields

[57] ABSTRACT

A scrag saw mill provided with a pair of dogging carriages each carrying a pair of dogs located at opposite sides of the log to be sawed. The dogs are operated by thrust rods from hydraulic cylinders to force the dogs into clamping positions on opposite sides of the log. Means are provided for causing either of said cylinders to exert a predominant force on the log to jog it into place and to equalize the forces to clamp it in place. The log is driven through the mill by an independently driven dog and the carriages are released from the log before they reach the saws. The carriages are returned to predetermine positions as the log proceeds through the final stages of its sawing process.

12 Claims, 17 Drawing Figures

SCRAG SAW MILL DOGGING SYSTEM

BACKGROUND OF THE INVENTION

A number of problems occur in the operation of scrag mills of the type in which a log is moved between a pair of circular power saws so as to cut a slab from each side of the log, producing what is called a "log cant". The slabs should be substantially equal in size. Therefore, the log should be centered, as closely as possible, between the saws. Such logs are never perfectly circular in cross section or straight in length, and usually possess a number of other irregularities. As a result, relatively large forces are exerted on the log, as it progresses through the mill, tending to twist it around its longitudinal axis and to move it laterally out of alignment with its desired path between the saws. To the extent that such movements do occur, the log tends to bind against the sides of the rapidly rotating saws, thus generating a great deal of thermal energy which heats the saws to excessively high temperatures. At such temperatures the saw blades warp out of shape giving rise to such vigorous vibrations that it often becomes necessary to stop the mill until the saws have cooled to normal temperatures. If the distortion of the saw blades is sufficiently severe, it may even become necessary to replace them by a fresh pair. The quality of the work may also be impaired. Of course the delays involved are highly objectionable.

Various prior art mechanisms have been devised for setting such logs in position with respect to the saws, usually by a series of knees and for clamping the logs in position by clamping dogs. However, the results still leave much to be desired. The operation is often quite time consuming and the ability of such mechanisms to hold the log in its desired position and path of travel throughout its entire passage through the saws is often insufficient to accomplish the desired degree of perfection. Such deficiencies are particularly marked when logs of different sizes and shapes are to be operated upon by a single mill.

Prior art devices also have been deficient in that the mechanism for moving the log throughout its length between the saws have not exerted enough of a force to eliminate the tendency of some logs to stall between the saws.

SUMMARY OF THE INVENTION

In the present invention the alignment of each log is accomplished by means of two carriages spaced apart along the length of the log and independently movable along the means for carrying the log through the saws. Each carriage has mounted in it a pair of dogs located on opposite sides of the dog carrying means. Hydraulic means are provided to force each of the dogs against opposite sides of any log deposited on the carrying means, and operator controls are provided for causing the force of either of the hydraulic means to dominate over the force of the other of the hydraulic means, the difference in the two forces being sufficient to move the log in the direction of the dominant force. Control means are also provided for making such two forces substantially equal to each other so as to lock the dog in its adjusted position. The hydraulic means is mounted so as to exert its force on its associated dog with a component of force in the direction of the log carrying means so as to hold the log firmly in position against such carrier. Independently operating drive means are provided to force the log through the saws. When the log is so moved it carries the carriages locked to it along with it. When each carriage arrives at a predetermined location adjacent the saws, it engages an operating device which controls means for forcibly retracting the dogs from the log, releasing the carriages from the log, and for returning each carriage to a predetermined initial position. Various additional adjustments and controls are provided to offer increased versatility of the operations under the immediate control of the operator.

DETAILED DESCRIPTION OF THE PREFERRED EMBODIMENT

Figure 1:
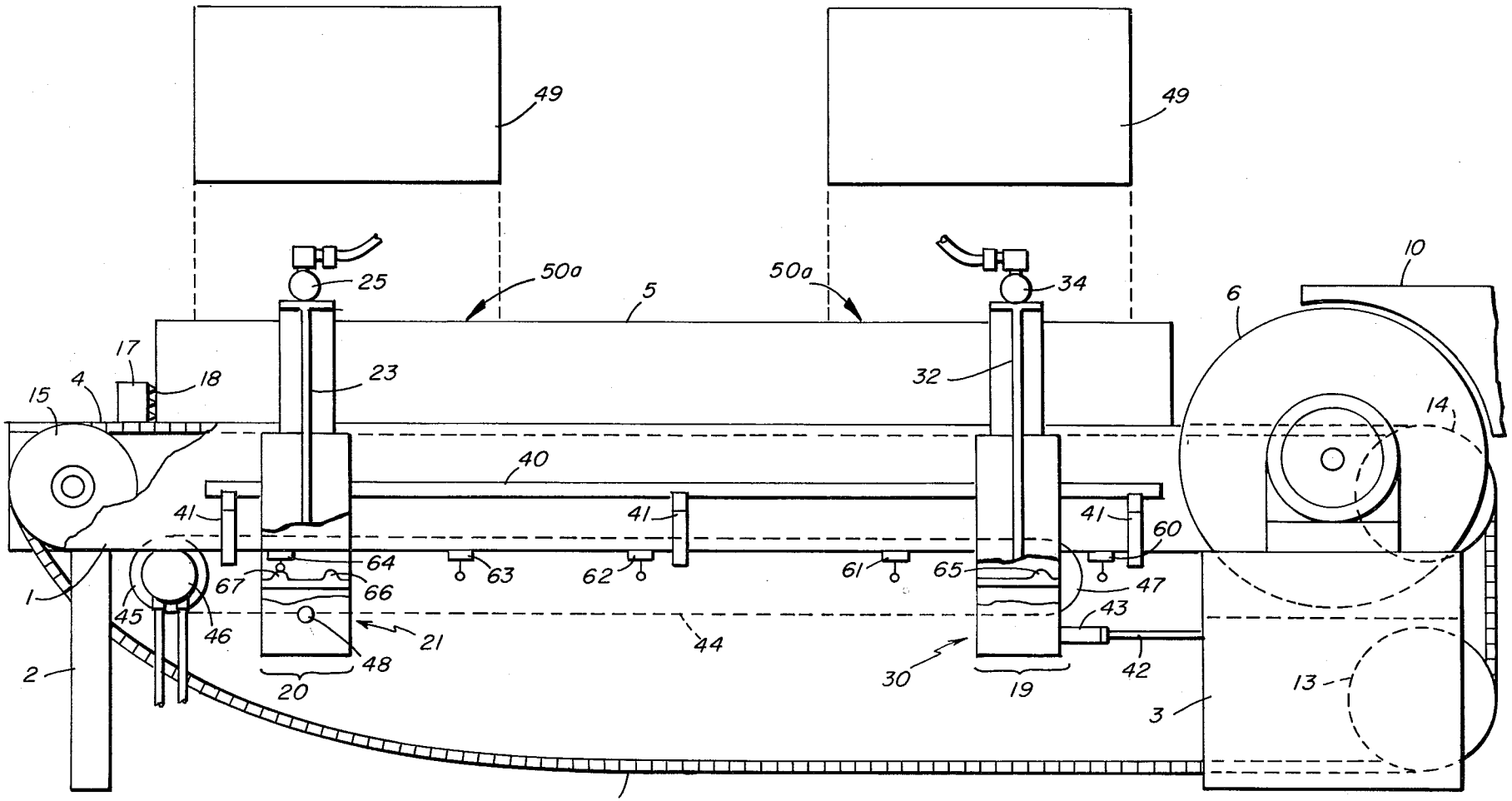
FIG. 1 is a side view of a scrag mill comprising a preferred embodiment of the invention.
Figure 2:
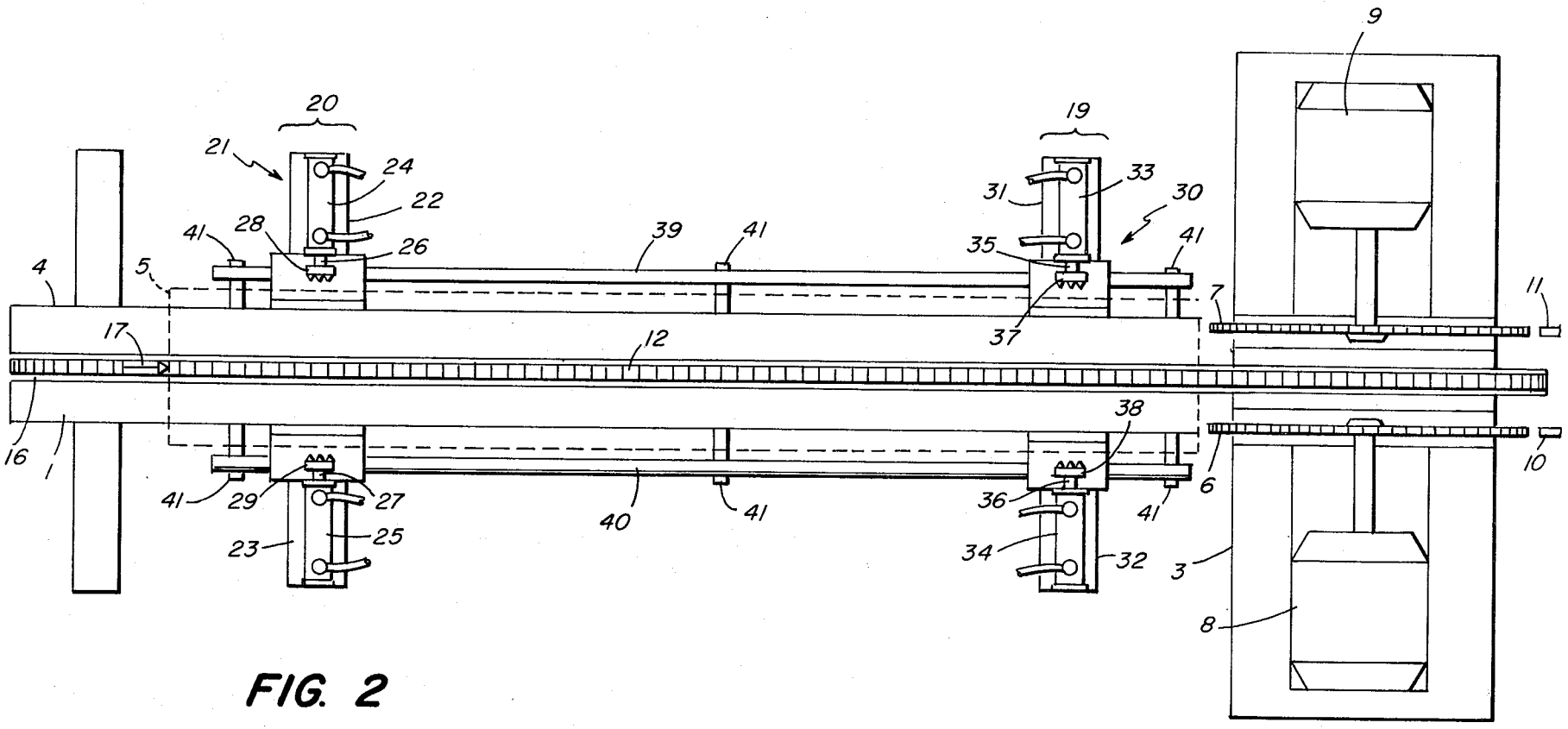
FIG. 2 is a top view of the mill shown in FIG. 1.

Referring to the drawings, the scrag mill comprises a base frame 1, shown partially broken away in FIG. 1 to show the underlying structure. The frame 1 is supported by a support member 2 at one end and a base member 3 at the other. The top of frame 1 provides a bed 4, along which the log 5 (shown in dotted lines in FIG. 2) is adapted to slide. A pair of saws 6 and 7 are driven respectively by motors 8 and 9, mounted on base member 3, and adapted to cut slabs of substantially equal size from the sides of log 5. The usual splitter plates 10 and 11 are mounted in line with the saws 6 and 7.

In order to move the log 5 between the saws 6 and 7 to provide the necessary strong positive push to prevent the log stalling between the saws, the mill is provided with a drive chain 12, driven by a hydraulic motor 13. Drive chain 12 is guided by a pair of chain pulleys 14 and 15 along a slot 16 formed along the center line of bed 4. A large dog 17 is attached to drive chain 12 and is adapted to push against the end of log 5 to force it between the saws 6 and 7 and to continue to exert a large pushing force against log 5 until it has been advanced beyond the saws. Dog 17 is sufficiently narrow to pass freely between the saws. Dog 17 is preferably (but not necessarily) provided with teeth 18 which engage the end of log 5.

In order to center log 5 along the bed 4, to align it with its desired path between the saws 6 and 7 and to clamp it firmly against any lateral or rotational movement, the mill is provided with two dogging devices 19 and 20. Dogging device 20 which is located at the left end of FIGS. 1 and 2, and is seen most clearly in FIG. 3, comprises a carriage 21 spanning the base member 3 and being provided with a pair of arms 22 and 23 extending above and on opposite sides of base member 3. The upper ends of arms 22 and 23 are angularly disposed with respect to the horizontal and carry hydraulic cylinders 24 and 25 respectively. These cylinders are of a standard type containing a piston (shown for example at 24*a* in FIG. 4) connected to a thrust rod 26 for cylinder 24, and 27 for cylinder 25. Thrust rod 26 carries a spiked dog 28 and thrust rod 27 carries a spiked dog 29. Dogging device 19 is substantially identical with dogging device 20. It comprises a carriage 30, a pair of arms 31 and 32 carrying cylinders 33, and 34 in which are located pistons operating thrust rods 35 and 36. Thrust rods 35 and 36 carry spiked dogs 37 and 38 respectively. Carriages 21 and 30 are mounted on circular guide rails 39 and 40, carried by brackets 41 secured to base frame 1. Carriages 21 and 30 are provided with bearings which permit them to slide freely along rails 39 and 40.

As will be explained below, carriages 21 and 30 will be carried toward the saws by their toothed dogs clamped against log 5 and which are released before they reach the saws. Upon such release, carriage 30 is moved in a direction away from the saws by means of a thrust rod 42 connected to a piston (not shown) in hydraulic cylinder 43 carried by carriage 30. The outer end of rod 40 abuts against base member 3.

The carriage 21 is also adapted to be moved in either direction along the rails 37 and 38 by means of a roller chain 44 (see FIG. 1) driven by the drive pulley 45 of hydraulic motor 46 and a guide pulley 47, each of which is mounted on the base frame 1 on its underside. Carriage 21 is pinned to the roller chain 44 by a pin 48 permitting the roller chain 44 to drive the carriage 21 in either direction depending upon the direction of rotation of the motor 46.

In order to guide the operator in aligning the log 5, means are provided for indicating the location of the center line of the desired path of the log between the saws 6 and 7. In the embodiment shown, such means consists of one or more standard type shadow lamps 49 which cast the shadow of a wire or cord 50 (see FIG. 3) along a line indicated at 50*a* on whichever log is deposited on bed 4.

The log 5, to be sawed, is deposited on bed 4 by any well-known loading mechanism approximately along the longitudinal axis of bed 4. The final positioning of the log is accomplished by the dogs 28, 29 and 37, 38 operated by the hydraulic cylinders 24, 25 and 33, 34. Each of these hydraulic cylinders and their associated mechanisms may be energized in any one of three conditions by the arrangement as shown diagrammatically in FIG. 4. In this Fig., cylinder 24 is chosen as the typical arrangement for all four cylinders. The cylinder 24 is supplied with a hydraulic fluid from a pump 51 through a reversible valve 52. In the position shown in FIG. 4, the fluid under the full pressure supplied by pump 51 is fed through pipe 53 to the left hand side of piston 24*a* which moves to its right hand limit while exerting its maximum thrust on thrust rod 26. Any fluid which may be located on the right hand side of piston 24*a* is forced out through pipe 54 and delivered by valve 52 to return pipe 55 leading to the usual reservoir of the hydraulic fluid. Valve 52 is provided with an operating arm 56 which, when moved to the position shown in dotted lines in FIG. 4, feeds the full pressure of the fluid to the right hand side of the piston 24*a* which moves to its left hand limit carrying thrust rod 26 with it and forcing the fluid in the left hand end of cylinder 24 back through a passage in valve 52 and out through return pipe 55. The third condition into which cylinder 24 may be placed, is created by means of a dump valve 57 interposed in pipe 53. Dump valve 57, when energized by a suitable operating member 58, opens a bleeder path out of pipe 53 through valve 57 to an exhaust pipe 59 into the return pipe 55. Under these conditions the pressure on the left hand face of piston 24*a* is greatly reduced. As will be explained below, the third condition is used at a time when a substantial back thrust is being exerted against rod 26 by an opposed cylinder and thrust rod. Due to the reduced pressure in cylinder 24, the thrust rod 26 and piston 24*a* are readily moved to the left. Arm 56 is moved into the position shown in FIG. 4 by means of a solenoid 92 and is biased toward the dotted position in FIG. 4 by a suitable biasing means 94 such as a heavy spring.

For purposes which will become apparent as the description proceeds, a number of microswitches 60, 61, 62, 63 and 64 are spaced along the bottom of base frame in a position to be engaged by one or more cam surfaces 65, 66 and 67 carried by carriages 21 and 30 as said carriages move along the guide rails 39 and 40.

The principal pump or hydraulic power for the entire system is supplied by a large motor 68 (e.g. see motor 68 in FIG. 4) which generates the principal hydraulic pressure in the system. Among other functions, its drive shaft 69 drives each of the cylinder pumps, one of which is shown at 51 in FIG. 4.

Figure 5A:
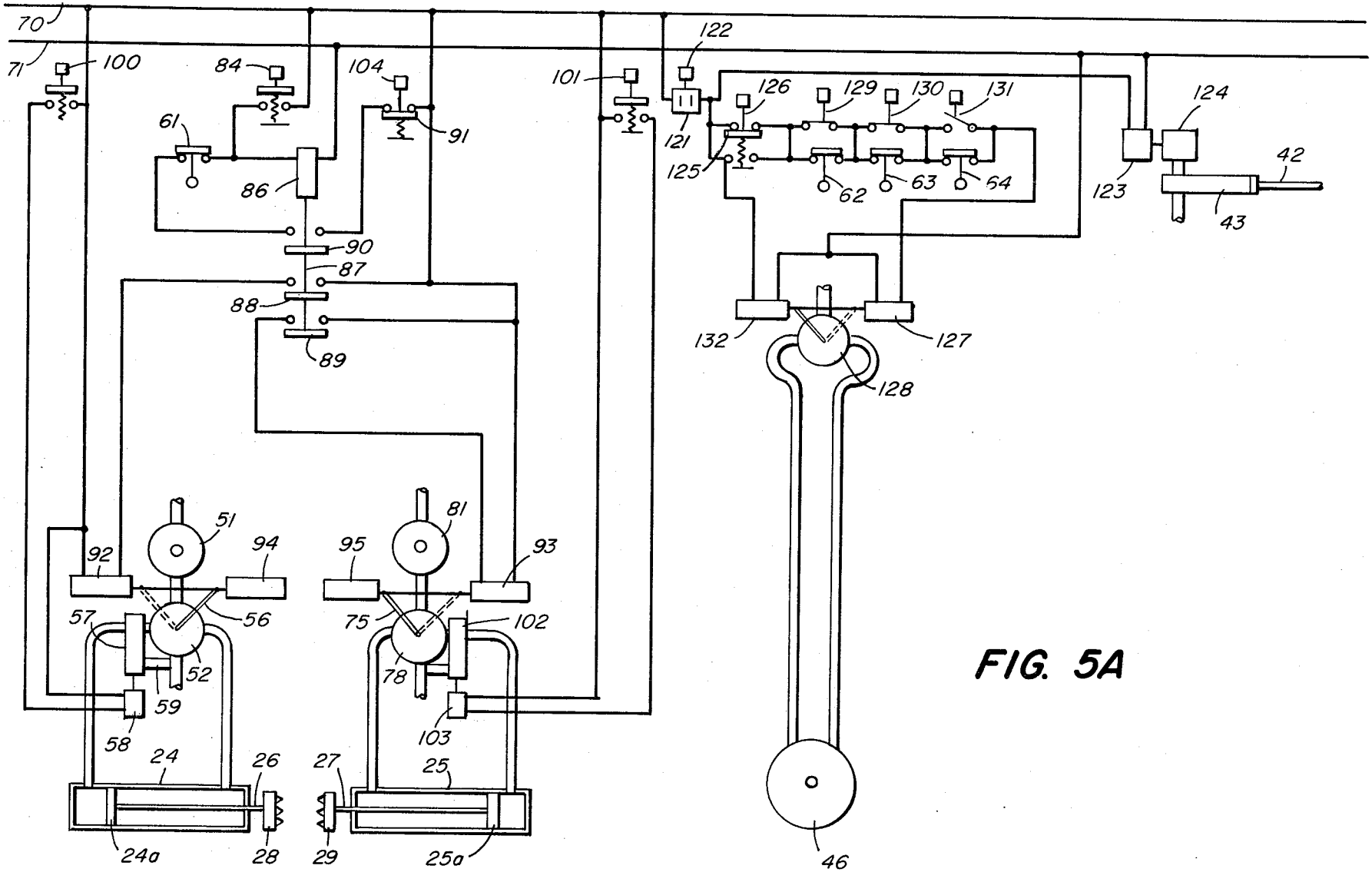
FIG. 5 (shown in two parts 5*a* and 5*b*) is a circuit diagram for the controls of the mill.
Figures 5B, 6:
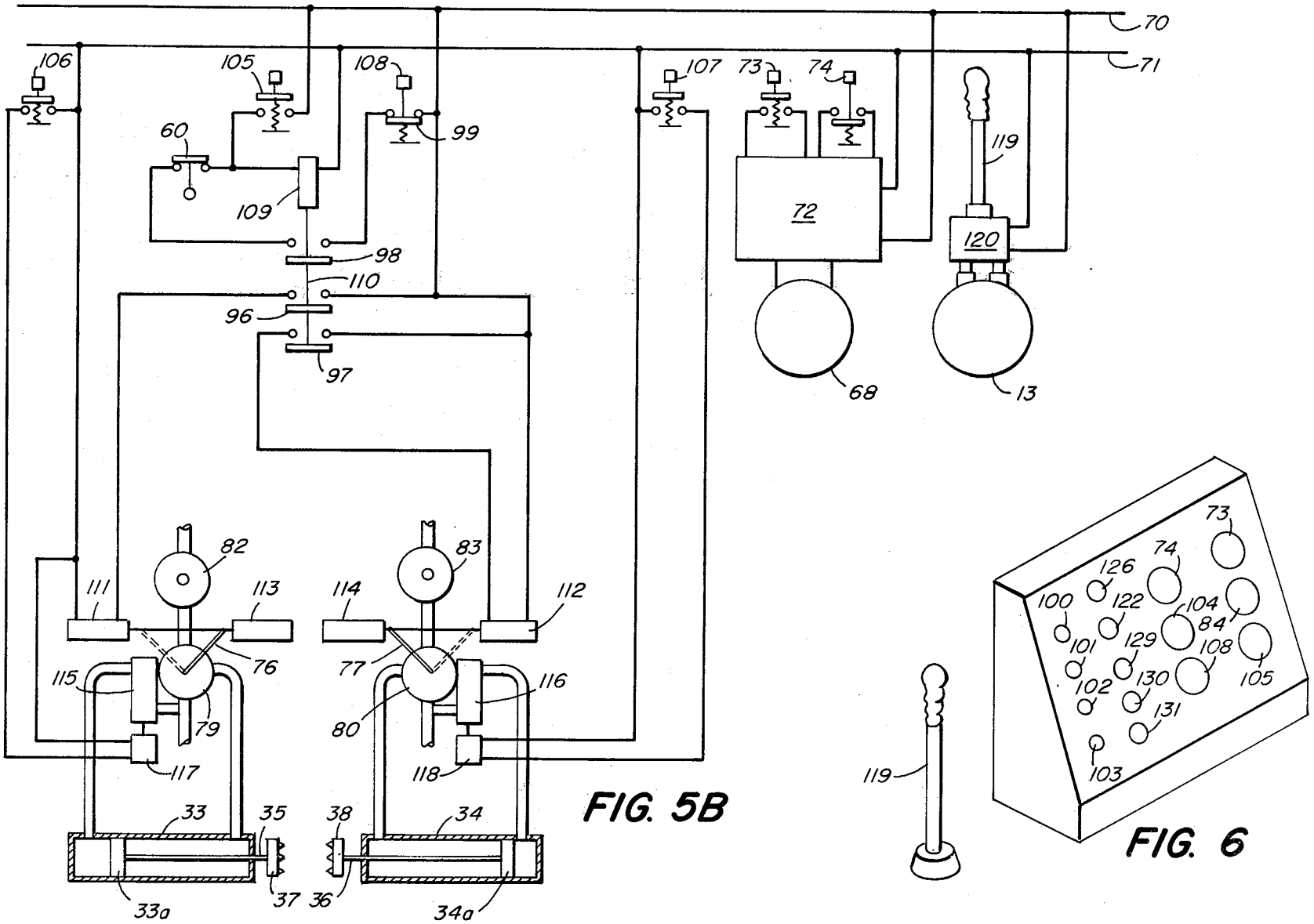
FIG. 6 is a view of a console which includes operating members for the switches shown in FIG. 4.

Referring to FIGS. 5*a* and 5*b*, power may be supplied to the system from a pair of power lines 70 and 71. Pump motor 68 may be energized from these power lines through a start and stop control 72. Motor 68 is started by operating push button 73 and stopped by operating push button 74. Since such a control is well known, its details need not be described further.

The pistons 24*a*, 25*a*, 33*a*, and 34*a* of cylinders 24, 25, 33, and 34 respectively are shown in FIGS. 5*a* and 5*b* in their fully retracted position, which is the normal position for these elements as of the end of a log sawing operation. In this position the operating arms 56, 75, 76, and 77 of reversible valves 52, 78, 79, and 80, feeding cylinders 24, 25, 33, and 34 respectively, are in a position to introduce into the forward position of each cylinder the full operating pressure of the hydraulic fluid supplied by the individual pumps 51, 81, 82, and 83 feeding said reversible valves. By the "forward portion" is meant the portion of each cylinder adjacent the end from which the associated thrust rod extends. "Rear portions" of the cylinder will be referred to as the portions opposite said "forward portions".

When a log is deposited on the bed of the mill, push button 84 is operated and closes an energizing circuit from line 71 through the operating solenoid 86 of a solenoid relay 87. Operating arms 56 and 75 of reversible valves 52 and 78 are operated by solenoids 92 and 93 the power of which is sufficient to overcome the bias of biasing means 94 and 95. When relay 87 pulls up, it closes an energizing circuit for said solenoids 92 and 93 through contact bars 88 and 89 of relay 87. Upon being energized, solenoids 92 and 93 overcome the biases of means 94 and 95 and the arms 56 and 75 move into their alternative positions. Since push button 84 closes its circuit only as long as it is depressed, it is necessary to establish a holding circuit for solenoid 86 when push button 84 is released. Such holding circuit extends around the contacts of push button 84 from line 71, through solenoid 86, micro switch 61, hold-in contact bar 90 of relay 87, and the normally closed contact 91 of push button 104. When solenoids 92 and 93 are operated they move arms 56 and 75 into the position in which the full pressure from pumps 51 and 81 is fed to the rear portions of cylinders 24 and 25. Therefore, the pistons 24*a* and 25*a* are pushed forward causing their associated thrust rods 26 and 27 to project and force the dogs 28 and 29 against the opposite sides of the intervening log. As will be explained later, the transverse forces exerted against the log, at this point, are substantially equal and opposite so that no transverse motion of the log will result.

As already explained it will almost always be necessary to move the log transversely in order to align it properly. It further is highly desirable that this be done quickly and accurately. This type of adjustment is provided herein by an action under the control of push buttons 100 and 101. If it is desired to move the log in a direction toward cylinder 24 (upward in FIG. 2), push button 100 is operated to energize solenoid 58 of dump valve 57. As explained with respect to FIG. 4, this bypasses a sufficient amount of fluid from pump 51 to reduce the pressure in the rear portion of cylinder 24 to a relatively small value. At the same time the full pressure of cylinder 25 is being exerted through its thrust rod 27 and dog 29. The resulting unbalance of forces is great enough to cause the log to move transversely in the direction of cylinder 24. However, dump valve 57 is energized only as long as push button 100 is engaged. As soon as push button 100 is released, the full pressure from pump 51 is delivered to the rear portion of cylinder 24 which pressure, being equal and opposite to the pressure exerted from cylinder 25, stops all transverse motion of the log and locks it in position. During all of this time, the dogs 26 and 27 are kept firmly in place against the log and no time interval is permitted to occur for any travel time of a dog into log contact. Such interval could produce an undesirable transverse movement of the log after the operator has determined that the log had reached its proper position.

Should the operator decide that a transverse adjustment of the log toward cylinder 25 (downward in FIG. 2) is needed, push button 101 is operated. Reversible valve 78 is provided with a dump valve 102 and operating solenoid 103 corresponding exactly to the dump valve 57 and solenoid 58 associated with cylinder 24. Operation of push button 101 energizes solenoid 103 so that lateral motion of the log toward cylinder 25 is accomplished by operating push button 101 in exactly the manner as explained for push button 100.

Later in the operation of the mill, it will be desired to exert a powerful pull on each of the dogs 28 and 29 to retract them from contact with the log. Push button 104 is also provided for such purpose. When push button 104 is operated it interrupts the holding circuit for solenoid 86 previously described. Therefore, relay 87 is deenergized which opens contact bars 88 and 89 to deenergize solenoids 92 and 93, whereupon arms 56 and 75 are free to move under the action of biasing means 94 and 95. Consequently, biasing means 94 and 95 move arms 56 and 75 to a position in which the full pressure of the fluid delivered by pumps 51 and 81 is delivered to the forward portions of cylinders 24 and 25 which exert a powerful pull on each dog 28 and 29 to extract them from the sides of the log and move them rapidly out of the path leading to the saws.

Having adjusted the position of the rear portion of a log by the dogs 28 and 29, carried by carriage 21, the system provides similar means for adjusting the positon of the forward portion of the log by the dogs 37 and 38 carried by carriage 30. This is accomplished by the control circuit arrangment as shown at the left of FIG. 5*b* connected to the cylinders 33 and 34. This arrangement is exactly the same as described with reference to FIG. 5*a*. Push buttons 105 through 108 correspond to push buttons 84, 100, 101, 104; solenoid 109 corresponds to solenoid 86, relay 110 corresponds to relay 87, biasing means 113 and 114 correspond to biasing means 94, 95, solenoids 111 and 112 correspond to solenoids 92 and 93; valves 115 and 116 correspond to valves 57 and 102; and solenoids 117 and 118 correspond to solenoids 58 and 103. Micro switch 60 corresponds to micro switch 61; and contact bars 96, 97, 98, and 99 corresponded to contact bars 88, 89, 90, and 91. Corresponding elements operate in exactly the same manner as described with reference to FIG. 5*a*.

Once the log has been aligned and clamped in position, it is forced to move between the saws 6 and 7. This operation is initiated by means of a hand operated lever 119 which operates a standard type of control 120 for setting the drive chain hydraulic motor 13 into operation, thus driving the dog 17 against the rear of log 5 with a powerful push.

It will be noted that by this time both carriages 21 and 30 have been securely clamped to log 5 by dogs 28, 29, 37, and 38 and therefor are carried along by the log as it moves toward the saws. As carriage 30 approaches the saws, its cam 65 engages micro switch 60. Referring to FIG. 5*b*, micro switch 60 opens its contacts which interrupt the holding circuit for solenoid 109 which drops relay 110 and opens the energizing circuits for solenoids 111 and 112. Biasing means 113 and 114 then move arms 76 and 77 to the position in which the dogs 36 and 37 are forcibly retracted from the log as described above. In order to move carriage 30 back to its original position, a press switch 121 is closed by it operating button 122 and connects a solenoid 13 between lines 70 and 71. Solenoid 123 operates a valve 124 which introduces hydraulic fluid into cylinder 43 which forces its thrust rod 42 to move carriage 30 to its original position.

When carriage 30 has been disconnected from log 5, carriage 21 continues to be carried along by its dogs 28 and 29 clamped against log 5. This continues until cam 66 on carriage 21 engages microswitch 61 which opens the holding circuit for solenoid 86 dropping relay 87 to open contact bars 88 and 89 to deenergize solenoids 92 and 93 and permit biasing means 94 and 95 to reverse valves 52 and 78. As a result dogs 28 and 29 are quickly and forcibly retracted from log 5, disconnecting carriage 21 from the log.

At this stage, the system provides means for moving carriage 21 back to any one of a number of predetermined positions. The motive force for such movement is supplied from the small hydraulic motor 46 which drives carriage 21 through roller chain 44 and pin 48. When press switch 121 was closed, it closed a circuit from line 70 through contact bar 125, normally biased to close an upper pair of contacts of a two position push button switch 126. The circuit then proceeds through a series of micro switches 62, 63, and 64, and then through solenoid 127 of a reversible hydraulic valve 128 back to line 71. Valve 128 is of the type described for valve 52 except that when neither of its operating solenoids 127 and 132 are energized, the valve is biased to a central or closed position in which no fluid is supplied to motor 46. When solenoid 127 is energized, it supplies fluid to motor 46 to cause it to rotate in a direction which tends to move carriage 21 to the left in FIG. 1. Such direction may be termed the "reverse" direction. Motor 46 is quite small and, irrespective of the flow of fluid through it, is easily rotated in the "forward" direction by motion of the carriage 21 under the large driving force exerted by the motion of the log. However, when carriage 21 is released from the log, motor 46 assumes control and starts to propel carriage 21 in the reverse direction. It will be noted that connected across the microswitches 62, 63 and 64 is a series of switches 129, 130, and 131 respectively. The purpose of the microswitches 62, 63, and 64 is to predetermine the position to which the carriage 21 is returned to accomodate the size of the next incoming log. If it is decided to stop carriage 21 when it reaches microswitch 64, switches 129 and 130 are closed and switch 131 is left open. Therefore the opening of microswitches 62 or 63 by cam 67 on carriage 21 will not open the energizing circuit for solenoid 127. However, when cam 67 opens microswitch 64, the energizing circuit to solenoid 127 will be interrupted and valve 128 will be closed and motor 46 will stop. Should some other location be selected in which carriage 21 is to be stopped the switch across the appropriate micro switch will be left open. Although three positions are shown in FIG. 1 at which carriage 21 may be stopped, it will be understood that any desired number of such positions may be provided by additional microswitches spaced along base frame 1.

Should the operator decide that carriage 21 should be moved forward from the position at which it was stopped by a microswitch, push button 126 may be depressed to cause its contact bar 125 to open its upper pair of contacts and close its lower pair of contacts. This completes an energizing circuit for solenoid 132 which operates valve 128 to supply fluid to motor 46 to cause it to rotate so as to move carriage 81 in the forward direction. This continues only as long as switch 126 is depressed. By appropriate manipulation of switches 126, 129, 130, 131 and 121 the carriage 21 may be stopped at any denied location to accomodate whatever size of log is to be sawed.

The various control elements to be manipulated by the operator may be mounted on a console 133 as shown in FIG. 6 and put in a convenient location overlooking the mill so that the operator may observe and control the sequence of operations.

DESCRIPTIONS OF A TYPICAL SEQUENCE OF OPERATIONS

The operator will prepare for a typical sawing procedure by pushing button 73 to start the main pump motor 68 so as to build up the desired hydraulic pressures in the system. Since relays 87 will be in their deenergized position, the dogs 28, 29, 37 and 38 will move to their fully retracted positions. A log 5 will then be deposited on bed 4 and the shadow lamps 49 will be lit to cast the guidance shadow 50*a* along the top of the log. Usually, the carriage 21 will already be in the desired position with respect to the rear portion of 10*g* 5. If not, the operator may move it into such position by his manipulation of switch controls 126, 122, 129, 130, and 131. If he expects succeeding logs to be of approximately the same size as the first, he will open that switch 129, 130 or 131 which is across the micro switch 62, 63, or 64 which is closest to the desired position of the carriage 21 so that it will automatically return to that position in each subsequent operation.

Figure 3:
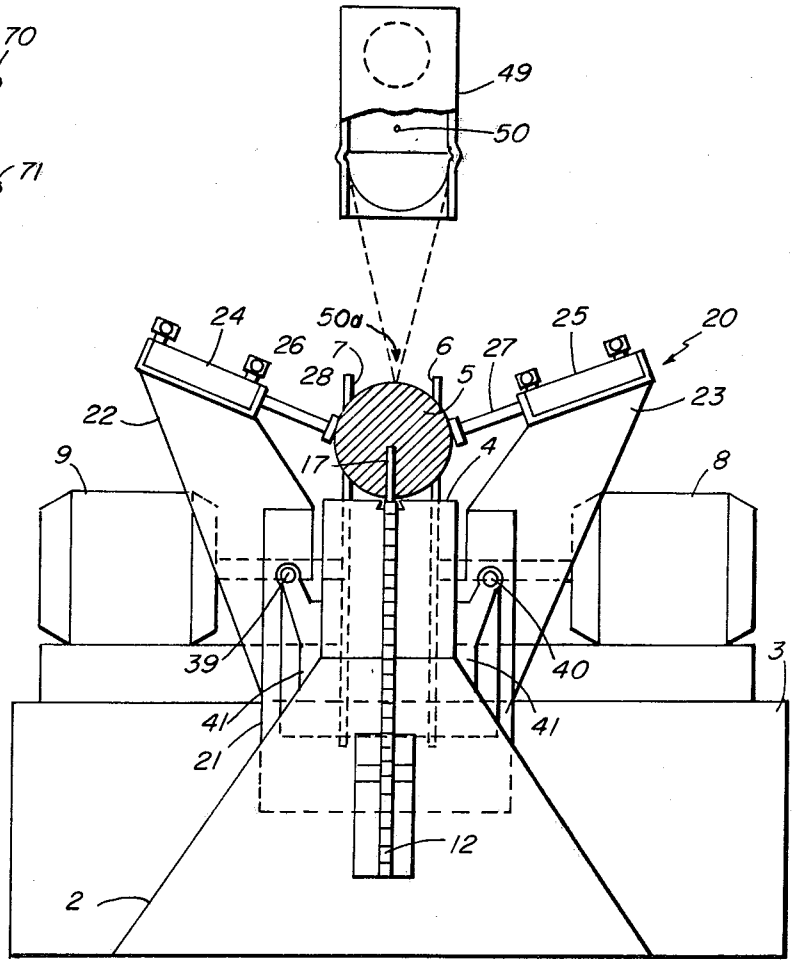
FIG. 3 is an end view as seen from the left of FIGS. 1 and 2.
Figure 4:
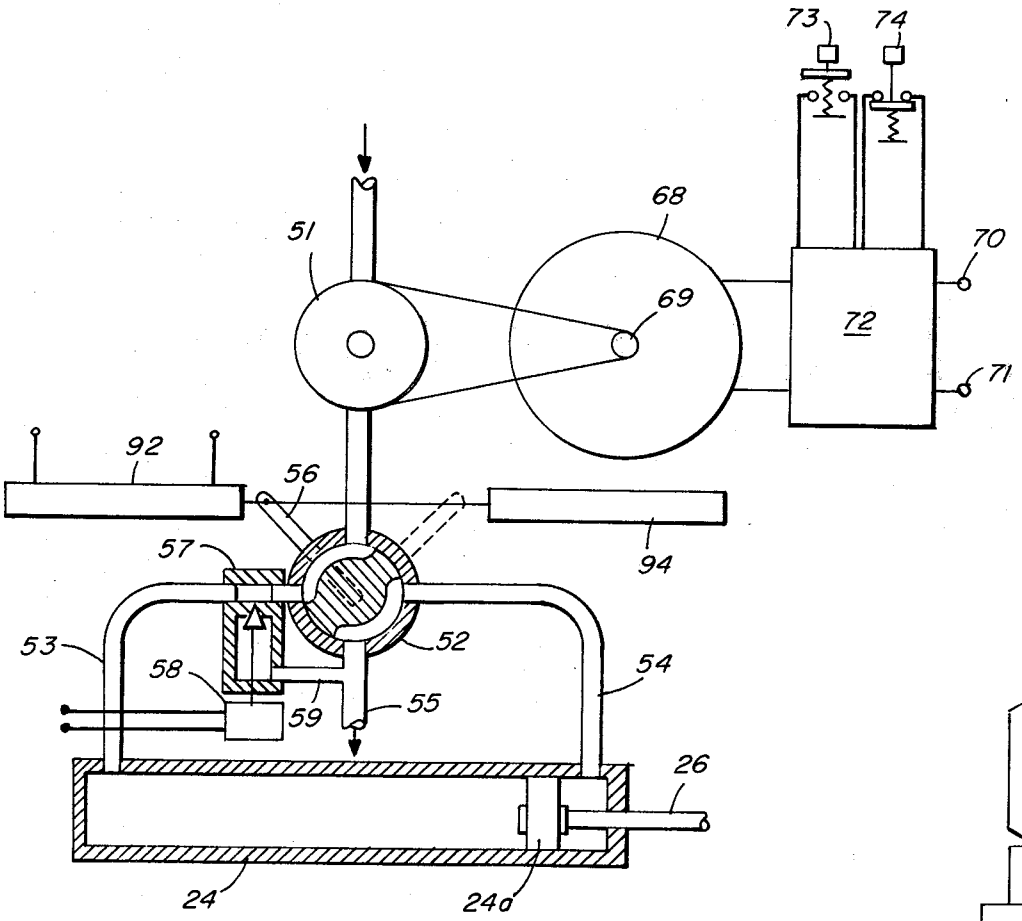
FIG. 4 is a diagrammatic view, typical of the four dog operating mechanisms for positioning a log.

Upon observing the position of shadow 50*a* along the top of log 5 adjacent carriage 21, he will determine how much of a lateral adjustment of the log is required to bring its center into coincidence with such shadow. Depressing button 100 will move the log to the right (e.g., upward in FIG. 2) and depressing button 101 will move it to the left. Such buttons may be termed "jogging" buttons whereby the log may be quickly and rapidly "jogged" into its proper position. When that position has been reached the dogs 28 and 29 will have locked log 5 in position. It should be noted, as shown in FIG. 3, that each thrust rod 26 and 27 is mounted to move in a direction at a downward angle with respect to the horizontal so that the force which it imparts to the log 5 through dogs 28 and 29 has a substantial component, not only along the horizontal, but also in the vertical direction toward the bed 4. When the jogging has been completed, the horizontal components of force of the two thrust rods will be substantially equal and opposite, thus preventing any further transverse movement of the log. However, the vertical components of these forces are in the same vertical direction and combine to exert a very powerful vertical force on the log against the bed 4. The result is a very powerful restraint exerted on the log against any rotation and against any transverse motion.

Having fixed the rear portion of log 5 in its proper position, the operator then repeats the same jogging procedure for the forward portion of the log by push buttons 106 and 107 controlling the cylinders 33 and 34 on carriage 30. Since both the rear and forward portions of log 5 will have been aligned with the guide shadows 50*a*, the entire log is now in the desired orientation with respect to its desired path of travel past the saws 6 and 7. It will be understood that these saws will have been set in rotation by energizing their driving motors 8 and 9 in accordance with standard saw mill procedures.

The operator will close switch 122, if is not already in its closed position, and then moves hand lever 119 to energize the powerful hydraulic motor 13. Motor 13 will drive chain 12 to bring dog 17 into driving engagement with the back end of log 5 and then to force the log through its complete path past the saws 6 and 7. It should be noted that the entire force needed for so moving the log is supplied entirely by the dog 17 as driven by motor 13 and that none of such force is supplied by the dogs 28, 29, 37 and 38. Such separation of the forces applied to log 5 insure that the functions which the dogs 27–38 are called upon to perform are not compromised by requiring them to exert any of the pushing force supplied by dog 17.

When carriage 30 reaches the position where its cam 65 opens microswitch 60, it will be released from log 5 and returned to its original position by thrust rod 42, all as previously detailed. Despite such release, the locking forces exerted by dogs 28 and 29 will still be exerted so that the log 5 continues to be constrained to continue in its passage through the sawing position in the desired manner.

When carriage 21 reaches the position where its cam 66 open microswitch 61, it will also be released from log 5 and returned to its predetermined position by roller chain 44, all as previously detailed. Dog 17, however, continues its powerful drive of the log until it has completely passed the saws 6 and 7. Before carriage 21 has been released, log 5 will have entered the space between splitter plates 10 and 11, which plates themselves tend to prevent twisting of the log 5 during its passage between them. The relative locations of the various parts of the machine could also be designed to have the log 5 enter between the splitter plates even prior to the release of carriage 30.

As soon as one log has passed through saws 6 and 7, the operator may move lever 119 to stop motor 13 so as to stop dog 17 behind where it would be expected to contact the next log. It is to be understood that drive chain 12 may be provided with more than one dog 17 spaced along chain 12 by appropriate distances to avoid the delay of having a single dog make the complete circuit back to its log engaging position.

Although a particular preferred embodiment of the invention has been described herein, it is to be understood that many variations may be made in the details of the mill and should be included in the scope of this invention as long as such variations meet the limitations of the invention as forth in the appended claims.

For example, some of the benefits of the invention would be present even with a single saw or with any other desired number of fixed or adjustable saws.

What is claimed is:

1. A saw mill comprising:

(a) a pair of power driven saws;

(b) an elongated carrier for supporting a log to be passed through said saws;

(c) a pair of spiked dogs supported adjacent opposite sides of the position to be occupied by a log on said carrier;

(d) power operated means for driving each of said dogs toward said position along a path having a substantial component transverse to the longitudinal axis of the log, said path also having a substantial component directed toward said carrier, whereby, upon contact of said dogs with said log, the log will be locked against transverse motion and clamped against said carrier;

(e) independent driving means for engaging said log, so locked and clamped, and for propelling said log along a path extending through and beyond said saws;

(f) said dogs being supported on a carriage which is mounted to be moveable as the dogs are carried along by being locked to said log as it moves toward said saws;

(g) means for reversing the power supplied to said power operated means to reverse the direction in which said power operated means drives said dogs; and (h) means, responsive to said carriage reaching a predetermined position adjacent said saws, for energizing said reversing means to disengage said dogs from said log.

2. A saw mill according to claim 1 in which each of said power means comprises a hydraulic cylinder, a piston within said cylinder, and a thrust rod carried by said piston, said thrust rod projecting from said cylinder and carrying one of said dogs.

3. A saw mill according to claim 1 in which said last named control means also energizes means carried by said mill to return said carriage to a predetermined position away from said saws upon said carriage being released from said log by the disengagement of its dogs from said log.

4. A saw mill according to claim 1 in which two of said carriages are mounted on said mill and spaced from each other along said carrier, each of said carriages carrying a separate pair of said dogs.

5. A saw mill according to claim 4 in which the said control means responsive to the position of each of said carriages also energizes means carried by said mill for returning the carriage to a predetermined position away from said saws upon the dogs of said carriage being disengaged from said log.

6. A saw mill comprising:

(a) a pair of power driven saws;

(b) an elongated carrier for supporting a log to be passed through said saw;

(c) a pair of dogs supported adjacent opposite sides of the position to be occupied by a log on said carrier;

(d) power operated means for driving each of said dogs toward said position along a path having a substantial component transverse to the longitudinal axis of the log, whereby, upon contact with the log, the dogs lock said log against transverse motion; and (c) control means for adjusting the relative forces exerted by said dogs to cause the force exerted by one of said dogs to be substantially greater than the force exerted by said other dog, whereby said log may be moved transversely in the direction of the predominant force.

7. A saw mill according to claim 6 in which each of said power means comprise a hydraulic cylinder, a piston within said cylinder and a thrust rod carried by said piston, said thrust rod projecting from said cylinder and carrying one of said dogs.

8. A saw mill according to claim 7 in which pump means are provided to supply hydraulic fluid under pressure to the face of the piston opposite the thrust rod for exerting the full force of said pressure to move said dog into contact with said log.

9. A saw mill according to claim 8 in which bleeder means are provided for opening a bleeder path from the portion of the cylinder into which said fluid is supplied, whereby the full force exerted on said piston is reduced.

10. A saw mill according to claim 9 in which means are provided for selectively energizing the bleeder means for either of said cylinders.

11. A saw mill according to claim 10 in which means are provided for deenergizing both of said bleeder means.

12. A saw mill comprising:

(a) a power driven saw;

(b) an elongated carrier for supporting a log to be driven past said saw;

(c) a pair of dogs supported adjacent opposite sides of the position to be occupied by a log on said carrier;

(d) power operated means for driving each of said dogs toward said position along a path having a substantial component transverse to the longitudinal axis of the log, whereby, upon contact of said dogs with said log, the log will be locked against transverse motion;

(e) means for driving said log, so locked, along a path extending through and beyond said saw;

(f) means for retracting said dogs from said log; and (g) means, responsive to said dogs reaching a predetermined position adjacent to and ahead of said saw, for energizing said retracting means to disengage said dogs from said log.

* * * * *